United States Patent [19]

Antes et al.

[11] Patent Number: 4,474,509

[45] Date of Patent: Oct. 2, 1984

[54] METHOD OF ERECTING A MARINE STRUCTURE UTILIZING A REMOVABLE WATERTIGHT PLUG ASSEMBLY

[76] Inventors: Ronald E. Antes, 35/38 Portman Sq., London, W1H OBN, England; Denis G. Hanys, 5865 San Felipe #17, Houston, Tex. 77057

[21] Appl. No.: 216,274

[22] Filed: Dec. 11, 1980

Related U.S. Application Data

[63] Continuation of Ser. No. 874,728, Feb. 3, 1978, abandoned.

[51] Int. Cl.[3] ..... E02B 17/00

[52] U.S. Cl. ..... 405/195; 138/89; 405/205; 405/227

[58] Field of Search ..... 405/8, 195, 205, 206, 405/207, 224, 227; 37/73; 114/296, 297, 300; 138/89; 206/616; 277/187; 285/18, 21

[56] References Cited

U.S. PATENT DOCUMENTS

| | | | |
|---|---|---|---|
| 1,898,658 | 2/1933 | Fitterer | 220/352 |
| 2,524,382 | 10/1950 | Goodman | 405/8 |
| 2,938,353 | 5/1960 | Vorenkamp | 405/207 |
| 3,306,052 | 2/1967 | Kawasaki | 405/205 |
| 3,496,900 | 2/1970 | Mott et al. | 405/224 X |
| 3,577,737 | 5/1971 | Burleson | 138/89 X |
| 3,613,381 | 10/1971 | Cox | 405/206 |
| 3,633,369 | 1/1972 | Lawrence | 405/205 |
| 3,828,968 | 8/1974 | Kask | 138/89 X |
| 4,142,371 | 3/1979 | Mayfield et al. | 405/224 |

*Primary Examiner*—David H. Corbin

*Attorney, Agent, or Firm*—Jack L. Hummel

[57] ABSTRACT

A method of erecting a marine structure at an offshore site of a body of water. The structure has a plurality of hollow tubular members associated with it. Examples of such members include skirt piles, conductors, legs, etc. The bottom portion of at least some of the members is sealed by a watertight removable plug with each plug provided with a plurality of normally closed vents. The vents, when opened, permit the pressure on both sides of the removable plugs to become substantially equal. After the structure is transported to the site, the tubular members are oriented substantially vertically with the bottom portion of the members extending downwardly. The structure is then submerged, preferably the bottoms of the tubular members engage the bottom surface of the body of water at the site. The vents in the plugs are opened, and after the pressure on both sides of each removable plug is substantially equal, the plugs are disconnected from the tubular members and are removed through the tops of their respective members by wire ropes to clear the interior of each of the members. Piling can then be driven to secure the structure to the bottom of the body of water.

16 Claims, 9 Drawing Figures

METHOD OF ERECTING A MARINE STRUCTURE UTILIZING A REMOVABLE WATERTIGHT PLUG ASSEMBLY

This is a continuation of our copending application Ser. No. 874,728, filed Feb. 3, 1978, now abandoned.

BACKGROUND OF THE INVENTION

1. Field of the Invention:

This invention relates to methods of erecting marine structures at an offshore site of a body of water, such as an ocean, by controlled submerging of the hollow tubular members associated with the structure. The lower portion of each of the members is closed by a watertight removable plug. Each plug is provided with a vent which is normally closed but which vent can be opened after the members are in contact with the bottom to substantially equalize the pressure on both sides of each of the removable plugs before the plugs are removed from their respective legs. Once the plugs are removed, piling are driven through the hollow legs into the bottom of the body of water to secure the structure in place.

2. Description of the Prior Art:

The increasing demand for oil and natural gas has resulted in a rapid increase in the drilling for oil and gas at offshore sites in bodies of water such as oceans, seas, lakes, straits, etc. and at steadily increasing depths of water. It is known to fabricate marine structures having hollow cylindrical members such as the main legs of the structure, skirt piles, conductors, etc. The bottom ends, or feet, of the main legs are adapted to contact the bottom of the body of water at the offshore site. The upper portions of the legs of the structure have, or are adapted to have, a platform secured to them. The lengths of the legs are chosen so that when the bottoms of the legs firmly engage the bottom of the body of water, the platform is above the highest waves likely to be encountered at the site.

Such structures are generally fabricated in shipbuilding facilities because of their size and weight, for example, the tubular members can be several hundred feet long. The structures are generally transported to the offshore site by barge, pontoons, or by towing the floating structure, normally in a horizontal position. To provide buoyancy when the structure is towed to its site, the tops and bottoms of the tubular members can be sealed to make them watertight.

At the site the structure is caused to float upright by selective flooding of the tubular members, by cranes lifting on the structure, or both. Then the structure is submerged until the bottoms of the legs contact the bottom surface of the body of water. Once the marine structure is in position with its legs firmly in contact with the bottom of the body of water, it is customary to drive skirt piling and/or piling through the legs into the earth to firmly secure the structure in place.

Removal of the plugs closing the bottom of the legs has presented problems. However, it is desirable to seal the bottom ends of the legs by plugs that can be readily removed and when the plugs are removed it is desirable that the interiors of the leg in which they were placed be left substantially clear of obstructions. Conductors and/or skirt piles may be built into the structure in the shipyard for convenience and to provide buoyancy to the erection site—plugs are useful in these tubular members. A zip-out plug is one such type of removable water-tight plug. A zip-out plug has a pressure vessel which is held in place in a tubular member of a marine structure by an elastomeric material, such as rubber, or a synthetic rubber, with a coil of wire rope embedded in the elastomeric material. The coils of the plug rope are substantially uniformly spaced apart so that a reasonable force applied to one end of the plug wire rope will cause the elastomeric material to fail progressively until the pressure vessel is no longer secured or attached to the inner wall of the tubular member. The other end of the plug wire rope used to disconnect the pressure vessel from the tubular member is secured to the pressure vessel to lift it out of the tubular member.

A zip-out plug solves many problems encountered in erecting marine structures such as providing a means for buoyancy that can be conveniently regulated, preventing silt and debris from entering into a tubular member while the plug is in position and reducing the remnants of the elastomeric material of the plug adhering to the inner wall of the tube after the plug is removed to a small, or negligible, amount which does not interfere with driving piling through the member. One set of problems not solved by such plugs is caused by the pressure differential which can, and generally does, exist across a zip-out plug at the time it is disconnected. Such a pressure differential can force, or drive, the pressure vessel of the plug up through the interior of the hollow, tubular member and possibly blow it out the top with a risk of damaging the marine structure and the men who may be working on or in its vicinity. If the pressure within the tubular member is greater, then the pressure vessel will be forced downwardly and could be forced out of the tubular member so that it would be difficult, if not impossible, to recover the pressure vessel particularly if the plug wire rope fails. A pressure vessel embedded in the earth could interfere with driving piling through the tubular member. A difference of pressure across the pressure vessel when the zip-out plug is disconnected from the tubular member can also cause the pressure vessel to become wedged, damaging the member, the pressure vessel and effectively blocking the tubular member to prevent piling from being driven through it.

Prior Art Statement

The following references are submitted under the provisions of 37 CFR 1.97(b): U.S. Pat. Nos. 2,979,910, Crake; 3,533,241, Bowerman et al; 3,577,737, Burleson; 3,613,381, Cox.

Crake (U.S. Pat. No. 2,979,910) discloses an offshore platform structure having hollow steel columns each of which is closed, or sealed, by a thin knock-out plate which is welded to the bottom of a column. The knock-out plates are ruptured by driving piling through them.

Bowerman et al (U.S. Pat. No. 3,533,241) discloses a rupturable seal assembly for closing the lower ends of the upright tubular members of marine drilling platforms. The seal assembly is provided with a circular flexible diaphragm of reinforced rubber which is readily rupturable by the piling used to secure the platform in place.

Burleson (U.S. Pat. No. 3,577,737) discloses a watertight plug assembly removably mounted in each of the tubular wells of an offshore platform. A rubber member is confined and compressed between a lower disc and an upper disc to engage the inner surfaces of the tubular wells. Pins on the plug assembly fit into sockets in the walls of the wells to fixedly position the assembly in a well until the assembly is to be removed.

Cox (U.S. Pat. No. 3,613,381) discloses a lower closure member for a hollow jacket column of an offshore structure which closure member has a truncated metallic cone whose periphery is welded to the wall of a jacket column. The truncated cone is provided with a tearing arm and a tearing strip. The tearing arm is connected to a wire rope and when the wire rope is pulled with adequate force the truncated cone is torn into smaller pieces prior to its being removed.

SUMMARY OF THE INVENTION

The present invention provides a method of erecting at an offshore site of a body of water a marine structure utilizing improved removable watertight zip-out plug assemblies to close the bottom portion of the hollow tubular members of the structure. Each zip-out plug is provided with at least one vent plug, or vent valve, which when removed, or opened, permits the pressure on both sides of the zip-out plug to equalize before the zip-out plug is disconnected from the tubular member in which it is positioned. Removal of the plugs from the piles and legs permits the driving of skirt piles and the driving of pilings through the legs to secure the marine structure to the bottom of the body of water so that the structure can withstand wind and wave action that may occur at the site.

It is therefore an object of this invention to provide a method of erecting marine structures in which the pressure on both sides of a removable watetight plug closing the bottom portion of a tubular member of such structure is substantially equalized before the watertight plug is removed with significantly reduces the risk of damage to the structure, to equipment used in erecting the structure, and to the pressure vessel of the removable plug as well as reducing the risk of injury to the men erecting the structure.

It is another object of this invention to provide a removable watertight zip-out plug for the tubular members associated with marine structures which plug is provided with normally closed vents, which vents can be releaseably and safely opened from the top of such members to equalize the pressure on both sides of the zip-out plug prior to removing a zip-out plug from its position in the tubular member.

Still another object of this invention is to provide a safer, more reliable and more economical method of erecting marine structures in relatively deep bodies of water.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENT

Figure 1:
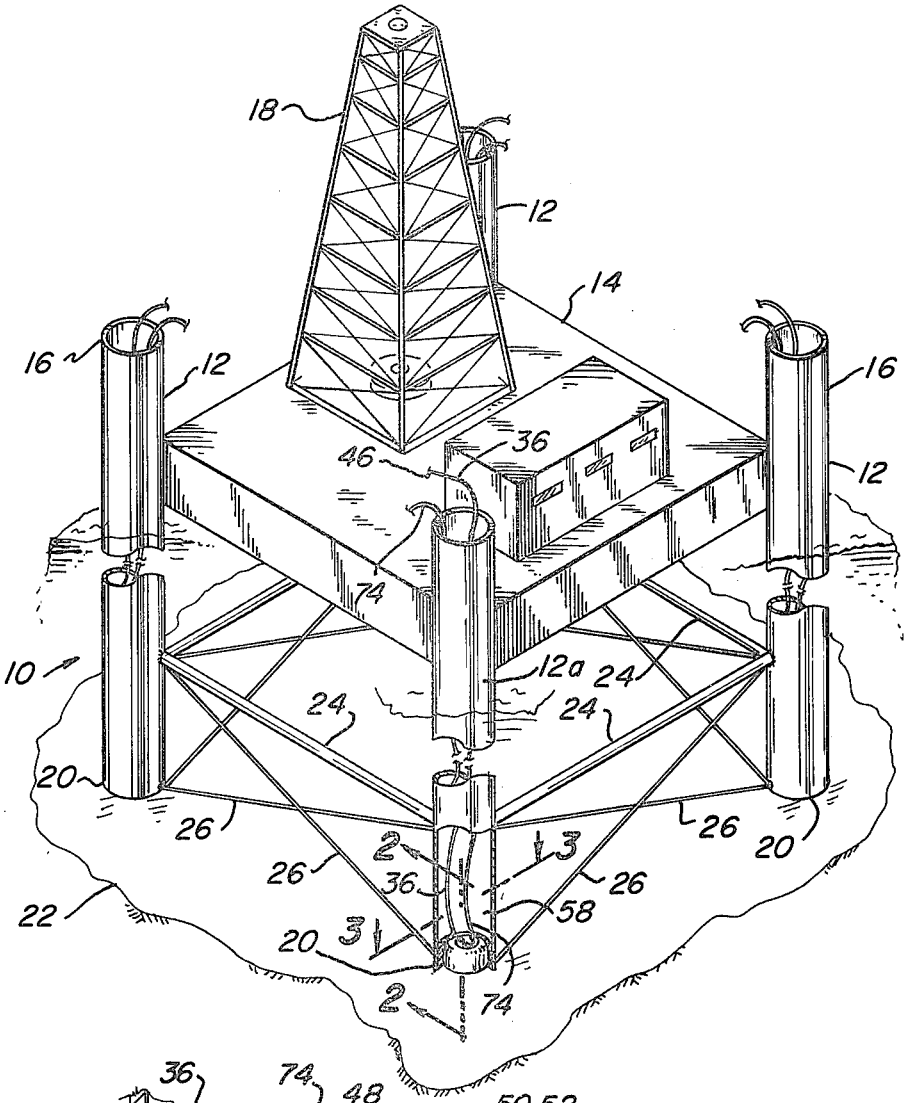
FIG. 1 is a fragmentary perspective view of a marine structure with the lower portions of its hollow tubular legs resting on the bottom of a body of water with one leg broken away to show the improved removable watertight plug.

In FIG. 1 marine structure 10 has a plurality of hollow tubular legs, or piling guides, 12, four in the embodiment illustrated. A platform 14 is secured to the upper portion 16 of legs 12. A conventional drilling rig 18 is illustrated as being mounted on platform 14. Obviously marine structure 10 can be used for purposes other than supporting an oil rig, but this is the most common use for such structures at this time.

Marine structure 10 is erected at some offshore site of a body of water, such as an ocean, sea, lake or strait, so that the depth of the water at the site can be determined. The length of legs 12, on the order of hundreds of feet, for example, is chosen so that when the bottom portion, or foot, 20 of each leg 12 is in firm contact with the bottom 22 of the body of water, platform 14 will be well above the highest waves expected at that site. Suitable bracing beams 24 and struts 26 are provided to make structure 10 more rigid. The structure can have skirt piles 100 and conductors 102, illustrated in FIG. 7, installed on the structure.

Figure 2:
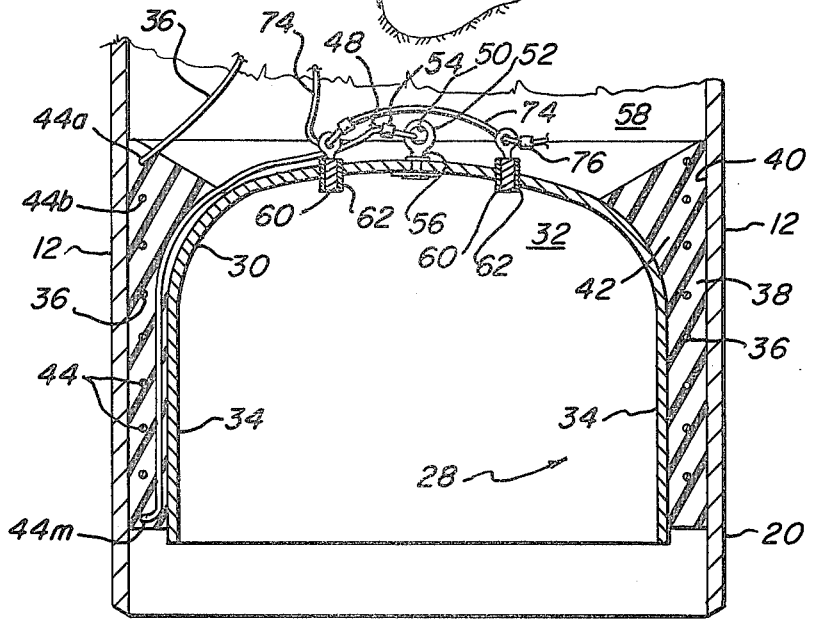
FIG. 2 is an enlarged section taken on line 2—2.

Referring now to FIG. 2, removable watertight plug or zip-out plug 28 with which each of the legs 12 is provided is illustrated—it is to be understood that plug 28 may be located in the skirt piles 100 and/or conductors 102 instead of the legs 12. Plug, or seal, 28 has a pressure vessel 30 which is fabricated preferably out of steel. Vessel 30 has a semi-hemispherical pressure dome 32 and a cylindrical skirt 34. In a preferred embodiment dome 32 is welded to skirt 34. The outside diameter of pressure vessel 30 is slightly less than the inside diameter of leg 12. In one embodiment of the invention the inside diameter of leg 12 is 46 inches and the outside diameter of pressure vessel 30 is 40 inches so that a three-inch gap exists between skirt 34 of pressure vessel 30 and legs 12 when pressure vessel 30 is substantially positioned in the center of leg 12, its normal position.

A plug wire rope 36 is coiled in space 38 between vessel 30 and the inner wall 40 of leg 12. Space 38 is filled with an elastomeric material 42 such as natural rubber or an artificial rubber to secure pressure vessel 30 in leg 12 at the pressures that it is expected to encounter when in use. Coils 44 of plug wire rope 36 are substantially uniformly spaced vertically as illustrated in FIG. 2 with the space between coils 44 filled with elastomeric material 42. Wire rope 36 is long enough so that one end 46 extends to the tope of leg 12*a*, for example, as seen in FIG. 1 where it can be connected to a winch, for example, which is not illustrated. The other end 48 of plug wire rope 36 is looped through eye 50 of eye bolt or padeye 52 and secured to plug wire rope 36 by clips, or clamps 54 (also see socket connectors 112 in FIG. 8). Eye bolt 52 is secured to pressure dome 32.

When elastomeric material 42 has set, or when an appropriate amount of cross linking has occurred between the polymers of elastomeric material 42, pressure vessel 30 is securely held in position in leg 12 and provides a watertight seal to prevent water from entering the interior 58 of leg 12 through or around plug 28 while plug 28 is in place. Elastomeric material 42, pressure vessel 30 and coils 44 of rope 36 together constitute plug 28. Seal 28 is illustrated as being located substantially at the bottom of leg 12*a*, in FIG. 2, but it can be placed anywhere in leg 12, pile 100 or conductor 102 or any other tubular member as circumstances may dictate. As long as zip-out plug 28 is in place, it prevents not only water from entering the interior 58 of leg 12 through it or around it but also prevents any silt or debris that may be located on the bottom 22 of the body of water in which structure 10 is placed from entering the interior 58 of leg 12.

Applying an appropriate force by means of a winch, for example, which is not illustrated, to the upper end 46 of plug wire rope 36 will cause wire rope 36 initially to rip out the portion of the elastomeric material 42 between the first coil 44*a* of wire rope 36 and the interior 58 of leg 12. Continued pulling on wire rope 36 will pull out each coil 44*b–n* in turn until the last coil, 44*n*, is removed which substantially disconnects pressure vessel 30 from wall 40. Continued pulling on rope 36 will apply a lifting force to eye bolt 52 to lift pressure vessel 30 out of leg 12. When pressure vessel 30 is no longer attached by elastomeric material 42 to inner wall 40 of leg 12, only a small amount of elastomeric material 42 will adhere to wall 40, of leg 12*a*, not enough to interfere with driving piling through leg 12.

Figure 4:
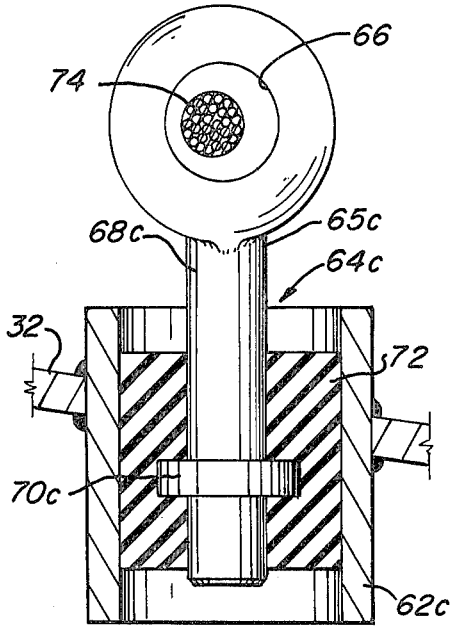
FIG. 4 is a greatly enlarged section taken on line 4—4 of FIG. 3 showing details of one embodiment of the vent with which a removable watertight plug can be provided.

To equalize the pressure on both sides of plug 28 before disconnecting pressure vessel 30 from wall 40 which unplugs, or unseals, the bottom portion 20 of leg 12, pressure dome 32 is provided with a normally closed vent or vents 60. Vents 60 have a cylindrical hollow vent pipe, or tube, 62 which extends through and is welded to dome 32. In the embodiment illustrated in FIG. 4, tube 62*c* is closed or sealed by vent plug 64*c* which is provided with a vent eye bolt 65*c* having an eye 66*c* and a shank 68*c*. A cylindrical flange 70*c* is formed, preferably integrally, on shank 68*c*. Vent bolt 65*c* is held in vent tube 62*c* by an elastomeric material 72 which can have the same or a similar composition as that of elastomeric material 42 used to hold plug 28 in position. When set, material 72 is sufficiently strong to easily withstand the pressure likely to be encountered at the site. Eye bolt 65*c* and material 72 as illustrated in FIG. 4 form vent plug 64*c*. Vent wire rope 74 passes through the eye 66*c* of vent eye bolt 65*c*. A vent clip 76*c* is secured to rope 74 to transmit sufficient force from vent cable 74 to pull vent plug 64*c* out of tube 62*c*.

Figure 3:
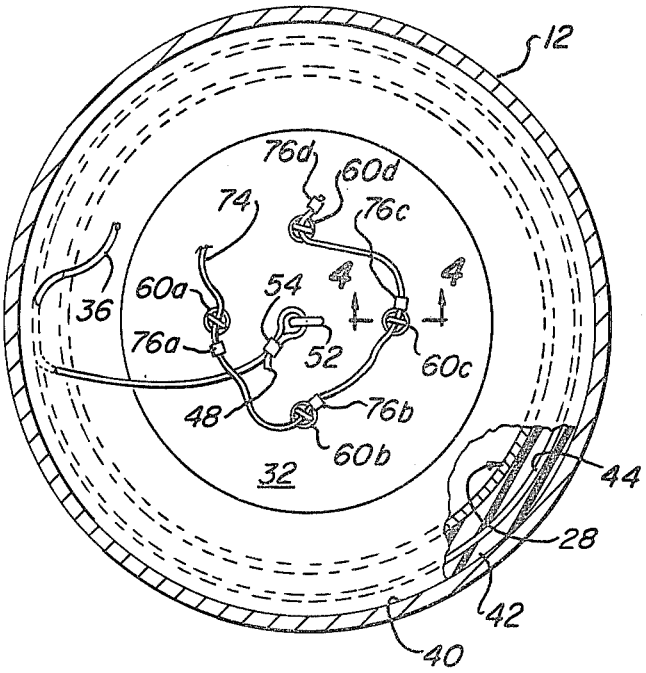
FIG. 3 is an enlarged section taken on line 3—3.

In the preferred embodiment, as illustrated in FIG. 3, four vents 60*a, b, c, d* are uniformly arranged around the center, eye bolt 52, of pressure dome 32. The interior diameter of vent tubes 62*a, b, c, d* is two inches in a preferred embodiment. Vent rope 74 extends in series through the eyes 66*a, b, c, d* of each of the four vent eye bolts 65*a, b, c, d*. Four clips 76*a, b, c, d* are secured to rope 74 with enough slack between clips 76 so that when the upper end of vent rope 74, which extends to the top of leg 12, is attached to a winch, for example, the force applied to rope 74 by the winch is transmitted to the eye bolts 65 in sequence so that vent plug 64*a* of vent 60*a* is pulled out of its vent tube 62*a* first, then vent plug 64*b* from its vent tube 60*b*, etc. The vent plugs 64*a–d* are removed from the interior of leg 12 by lifting, or removing, vent wire rope 74 to which plugs 64*a–d* are attached by clips 76*a–d*.

Figure 5:
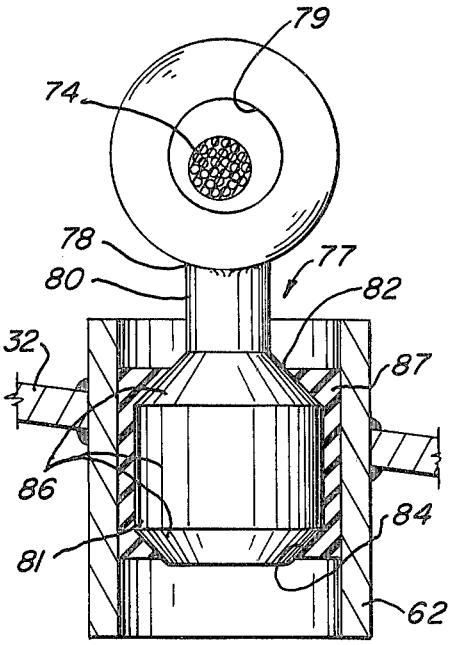
FIG. 5 is a view in section similar to that of FIG. 4 of another embodiment of a vent for a removable watertight plug.

In FIG. 5 vent plug 77, which is a different embodiment of the vent bolt illustrated in FIG. 4 has an eye bolt 78 which is provided with an eye 79 and a shank 80. Bolt 78 differs from bolt 64 in that cylindrical flange 81 of bolt 78 has a greater height and also a greater outside radius than flange 70*c* of bolt 65*c* illustrated in FIG. 4. In addition bolt 78 has two frustums of a cone 82, 84 on either side of flange 81, or describing bolt 78 another way, it has a frustoconical enlargement, or flange, 86 which is substantially encapsulated in elastomeric material 87 to hold vent bolt 78 in place within tube 62 until it is removed by force exerted by vent rope 74 and vent clip 76 acting against eye 79 of bolt 78. Bolt 78 and elastomeric material 87 together form vent plug 77. Vent plug 77 illustrated in FIG. 5 operates and functions in essentially the same manner as vent plug 64*c* illustrated in FIGS. 3 and 4 and can be substituted for vent plugs 64*a–d*.

Figure 6:
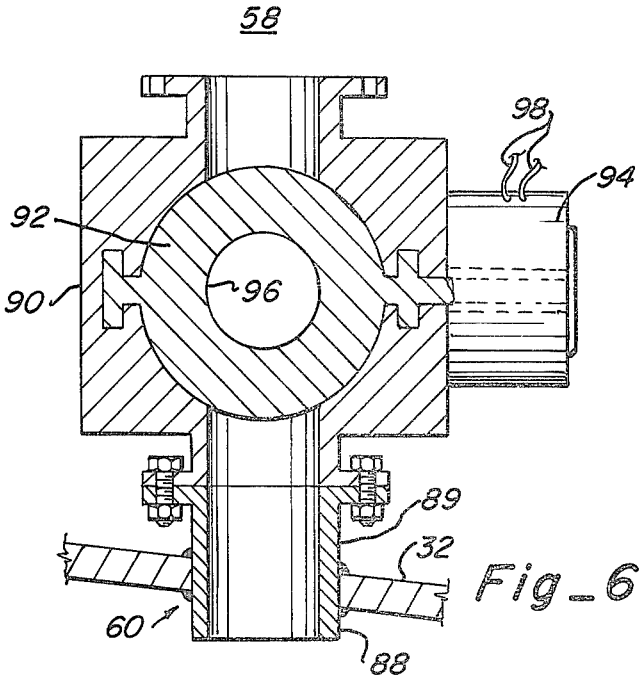
FIG. 6 is a view in section of still another embodiment of a vent that can be incorporated in a removable watertight plug.

In FIG. 6 still another embodiment of a vent 60 is illustrated. Hollow cylindrical vent tube 88 has bolted to its inner end 89 a conventional ball valve 90. When ball 92 of ball valve 90 is in its closed position, the position illustrated in FIG. 6, communication through vent tube 88 with the interior 58 of a leg 12 is blocked. Conventional solenoid actuator 94, when energized, causes ball 92 to rotate 90° to place valve 90 in its open position so that passae 96 through ball 92 is aligned with vent tube 88 and communication with the interior 58 of a leg 12 can occur through vent tube 88 and ball valve 90 to substantially equalize the pressure on both sides of pressure dome 32 of zip-out plug 28. Energization of solenoid 94 is by wires 98 which extend from the top of leg 12*a*, for example. Valve 90 is removed from leg 12 with pressure dome 32 to which it is fixedly attached.

Figure 9:
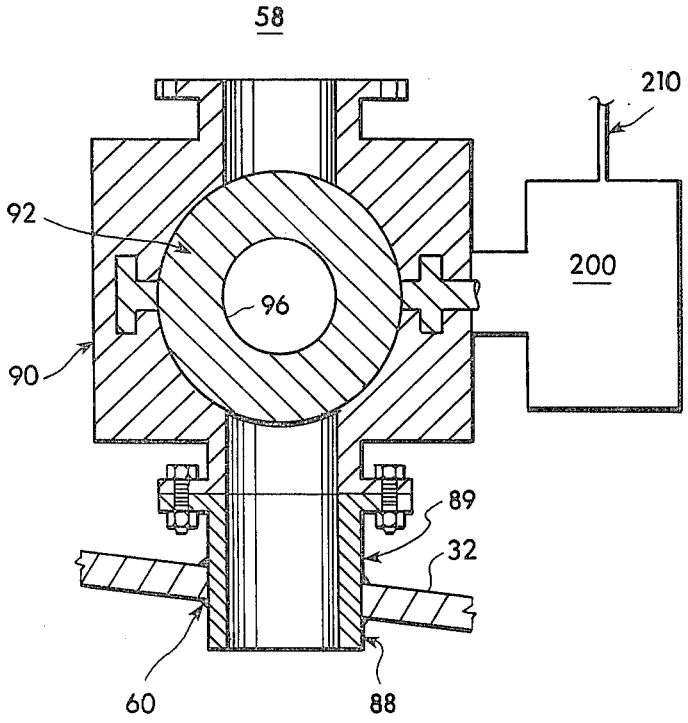
FIG. 9 is a representation of an embodiment of a vent for a removable watertight plug.

FIG. 9 is another embodiment of a vent 60 having substantially the same elements as the embodiment of FIG. 6 except that in FIG. 9, conventional ball valve 90 is actuated by a conventional pneumatic actuator represented by 200. Energization of pneumatic actuator 200 is by a pneumatical conductor line 210 which extends from the top of leg 12*a*, for example.

Figure 7:
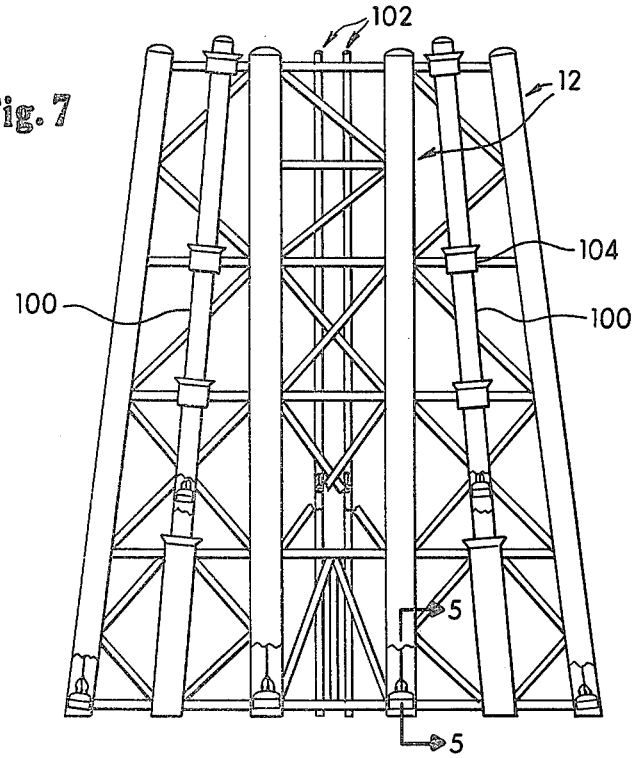
FIG. 7 is a front view of a marine structure with the lower portions of the hollow-tubular members resting on the body of water. The legs, skirt piling, and conductors are broken away to show the improved removable watertight plug.

FIG. 7 shows a structure with legs 12, skirt piles 100, and conductors 102. Skirt pile guides 104 guide the piles 100 as they are driven. The legs, conductors, and piles are broken away to show the zip-out plug in place. As mentioned previously, the zip-out plug can be placed on one or all of the legs, conductors, piles, but preferably the zip-out plug is placed in the skirt piles 100 and/or conductors 102. Of course, the zip-out plug can be placed in legs 12, however, a conventional diaphragm may be more practical for the legs.

Figure 8:
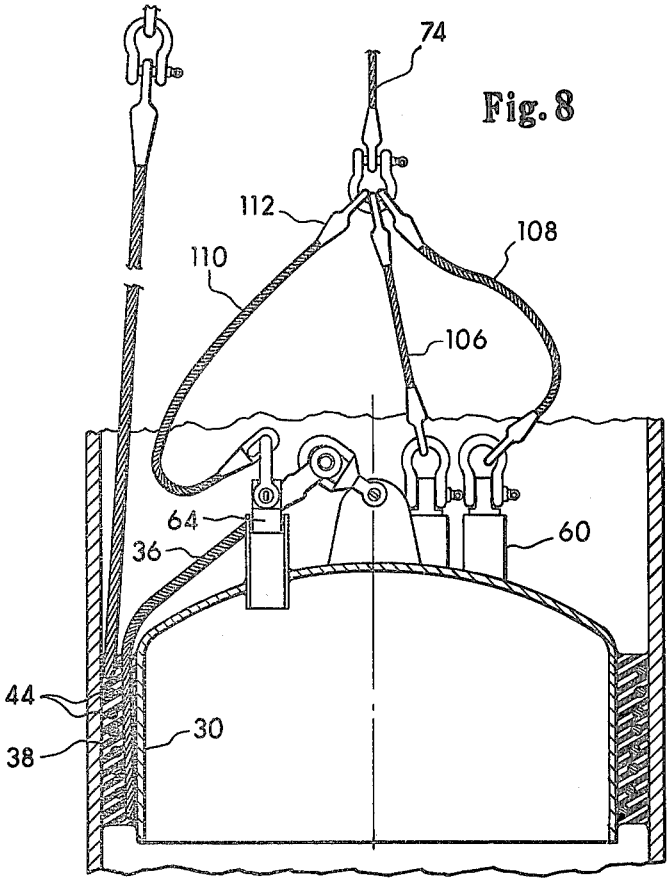
FIG. 8 is an enlarged section taken on line 5—5 of FIG. 7.

FIG. 8 is an enlarged section taken on lines 5—5 of FIG. 7. It shows a preferred method of connecting the vent rope 74 to vent plug 64. For example, vent rope 74 can be shackled to vent rope 106, vent rope 108 (which can be twice as long as vent rope 106), and vent rope 100 (which can be three times as long as vent rope 106). Also shown is the preferred method of connecting the vent ropes, i.e. by socket connectors 112.

The platform 14 may be secured to the legs at the time it is fabricatd or after the structure has been placed at the offshore site. Normally the upper portions of the tubular members are sealed, or made watertight, by conventional means, particularly if the structure is to be towed to its site while floating in the water. The manner of sealing the upper portions or ends can be by any suitable conventional way such as by welding a metal plate, etc. Once the marine structure reaches the site at which it is to be erected, it is set in a substantially upright manner by selective and controlled flooding of legs 12, skirt piles 100 and conductors 102, by the use of floating cranes, or by both. Once the structure has substantially the correct attitude in the water, it is further flooded by opening valves or by pumping water into legs 12, for example, to submerge the structure and cause the bottoms, or feet, 20 of legs 12 to contact or come to rest on the bottom 22 of the body of water at the offshore site at which marine structure 10 is to be erected.

When the structure is in contact with bottom 22, vent wire rope 74 can be attached to a winch, for example, and vent plugs pulled from their respective vent tubes. After the pressures are substantially equal on both sides of pressure vessel 30, plug wire rope 36 may be connected to a winch to unzip or remove zip-out plug 28 by disconnecting it from the inner wall of leg 12, pile 100, conductor 102, for example. Rope 36 is also used to remove pressure vessel 30 from the tubular member once pressure vessel 30 is disconnected from the inner wall of the tubular member.

From the foregoing, it is believed obvious that this invention provides a method of erecting marine structures that eliminates any pressure differential that exists across the pressure dome of a zip-out plug before the plug is unzipped, or disconected, and reduces the risk of damage to the structure, and the men erecting it and makes possible the recovery of the pressure vessel of the plug with a minimum risk of damage to the pressure vessel so that it may be used repetitively.

It should be evident that various modifications can be made to the described embodiment without departing from the scope of the present invention.

What is claimed is:

1. A watertight removable plug assembly for a hollow tubular member of a marine structure, comprising:

a pressure vessel, said pressure vessel having a pressure dome and a hollow cylindrical skirt integral with the dome;

an eye bolt secured to said pressure dome;

a plug rope;

one end of said rope being secured to said eye bolt, said rope being coiled in the space between the skirt of the pressure vessel and the inner wall of the tubular member;

the coils of said plug rope being substantially uniformly spaced from one another and from the walls of the member and the pressure vessel;

the space between the skirt of the pressure vessel and the inner wall of the tubular member not occupied by the plug rope being substantially filled with an elastomeric compound, the length of the plug rope being such that the other end extends at least to the upper end of the member;

a vent tube connected to the pressure dome;

means for closing the vent tube; and means controlled from the top of the member for opening the vent tube to permit communication through the pressure dome.

2. A watertight removable plug assembly as defined in claim 1 in which the means for closing the vent tube is a vent plug having an eye bolt, said eye bolt having an eye and a shank, a flange on said shank, and an elastomeric material removably holding the eye bolt in the vent tube to prevent fluids from flowing through the vent tube.

3. A watertight removable plug assembly as defined in claim 2 in which the flange on the shank of the eye bolt is substantially a right circular cylinder.

4. A watertight removable plug assembly as defined in claim 2 in which the shape of the flange on said shank is frustoconical.

5. A watertight removable plug assembly as defined in claim 2 in which the means for opening the vent tube is a vent rope extending through the eye of the vent eye bolt, said vent rope adapted to apply force to the vent eye bolt to pull the vent plug from the vent tube.

6. A watertight removable plug assembly as defined in claim 1 in which the means for closing the vent tube is an electrically actuated valve.

7. A watertight removable plug assembly as defined in claim 6 in which the means for opening the vent tube is an electrical conductor capable of transmitting electrical energy to the electrically actuated valve to open the valve to open the vent tube.

8. A watertight removable plug assembly as defined in claim 1 in which the means for closing and/or opening the vent tube is a pneumatically actuated valve.

9. In a watertight removable plug assembly for a hollow tubular member of a marine structure having a pressure vessel, said pressure vessel having a pressure dome and a hollow cylindrical skirt integral with the dome; a plug wire rope; one end of said rope being fixedly secured to said pressure dome, said rope being coiled in the space between the skirt of the pressure vessel and the inner wall of the tubular member; the coils of said wire rope being substantially uniformly spaced from one another and from the walls of the member and the pressure vessel; the space between the skirt of the pressure vessel and the inner wall of the tubular member not occupied by the wire rope substantially being filled with a flexible rubber-like compound, the length of the wire rope being such that the other end extends beyond the upper end of the member; the improvements comprising:

a plurality of vent pipes connected to the pressure dome, said vent pipes adapted to permit when not closed fluid to flow from one side of the pressure dome to the other;

means for closing the vent pipes; and means controlled from the top of the member for opening the vent pipes to equalize the pressure on both sides of the pressure dome.

10. In the plug assembly of claim 9 in which the means for closing the vent pipes are vent plugs, each of said vent plugs comprising a vent eye bolt having an eye and a shank, a flange on the shank, and elastomeric means for removably holding the flange and a part of the shank of the vent eye bolt in each vent pipe, such plugs preventing fluid from flowing through the vent pipes while a vent plug is positioned therein.

11. In the plug assembly of claim 10 in which the flange is substantially a right circular cylinder.

12. In the plug assembly of claim 10 in which the flange has a frustoconical shape.

13. In the plug assembly of claim 12 in which the means for permitting communication through the vent pipes is a vent wire rope extending through the eye of each vent eye bolt, a plurality of connectors secured to the vent wire rope, one for each vent eye bolt, said connectors being positioned on the vent rope to provide slack between each connector so that when force is applied to the vent wire rope to pull the vent rope in an upwardly direction, the force applied to the vent wire rope is applied in turn to each of the vent bolts to pull the vent plugs out of the vent pipes in sequence.

14. In a plug assembly as defined in claim 9 in which the means for closing the vent pipes is a valve having means which when energized will open the valve.

15. In a plug assembly as defined in claim 14 in which the means for opening the vent pipes is electrical conductor means which energize the valve.

16. In a plug assembly as defined in claim 14 in which the means for opening the vent pipes is pneumatical conductor means which energize the valve.

* * * * *

UNITED STATES PATENT AND TRADEMARK OFFICE

CERTIFICATE OF CORRECTION

PATENT NO. : 4,474,509

DATED : October 2, 1984

INVENTOR(S) : Ronald E. Antes

It is certified that error appears in the above-identified patent and that said Letters Patent are hereby corrected as shown below:

Col. 3, line 31: Delete "watetight" and insert --watertight--.
Col. 3, line 34: Delete "with" and insert --which--.
Col. 6, line 34: Delete "passae" and insert --passage--.
Col. 6, line 68: Delete "fabricatd" and insert --fabricated--.
Col. 8, line 67: Delete "12" and insert --10--.

Signed and Sealed this

*Nineteenth* Day of *March 1985*

[SEAL]

*Attest:*

DONALD J. QUIGG

*Attesting Officer* *Acting Commissioner of Patents and Trademarks*